US009403622B2

(12) United States Patent
Nolet et al.

(10) Patent No.: US 9,403,622 B2
(45) Date of Patent: Aug. 2, 2016

(54) MULTI-LEVEL STACKING CONTAINER

(71) Applicant: IPL INC., St-Damien (CA)

(72) Inventors: Roch Nolet, St-Joseph (CA); Luc Petitpas, L'Ancienne-Lorette (CA); Francis Côté, St-Nicolas (CA)

(73) Assignee: IPL INC., St-Damien (CA)

( * ) Notice: Subject to any disclaimer, the term of this patent is extended or adjusted under 35 U.S.C. 154(b) by 0 days.

(21) Appl. No.: 14/510,704

(22) Filed: Oct. 9, 2014

(65) Prior Publication Data

US 2015/0129451 A1 May 14, 2015

Related U.S. Application Data

(60) Provisional application No. 61/901,824, filed on Nov. 8, 2013.

(51) Int. Cl.
*B65D 21/02* (2006.01)
*B65D 21/06* (2006.01)

(52) U.S. Cl.
CPC ..... *B65D 21/062* (2013.01); *Y10T 29/4984* (2015.01)

(58) Field of Classification Search
CPC .... B65D 21/062; B65D 21/068; B65D 21/06; B65D 21/066
See application file for complete search history.

(56) References Cited

U.S. PATENT DOCUMENTS 2,026,204 A * 12/1935 Andrews ..... 206/506
4,105,117 A * 8/1978 Atkin et al. ..... 206/501
4,573,577 A 3/1986 Miller
6,938,772 B2 9/2005 Aiken et al.
7,014,043 B2 3/2006 Raghunathan et al.
7,017,745 B2 * 3/2006 Raghunathan ..... B65D 21/062 206/506
7,234,599 B2 6/2007 Hassell et al.
7,249,675 B2 * 7/2007 Hassell et al. ..... 206/506
7,320,405 B2 1/2008 Stahl
7,334,683 B2 2/2008 Hassell et al.
7,353,950 B2 4/2008 Stahl
7,464,817 B2 12/2008 Raghunathan et al.
7,484,621 B2 2/2009 Apps et al.
7,549,554 B2 6/2009 Hassell et al.
7,581,641 B2 9/2009 Hassell et al.
7,669,713 B2 3/2010 Stahl
7,891,491 B2 2/2011 Aiken et al.
8,047,369 B2 11/2011 Stahl (Continued)

FOREIGN PATENT DOCUMENTS

CA 1144879 4/1983
CA 2408247 C 11/2001
CA 2367649 C 7/2002
CA 2485544 12/2003

(Continued)

*Primary Examiner* — Jeffrey Allen
(74) *Attorney, Agent, or Firm* — Goudreau Gage Dubuc; Gwendoline Bruneau

(57) ABSTRACT

A container comprising a pair of bars extending across opposite sidewalls; wherein each one of the opposite sidewalls comprises an opening comprising a lower corner, an upper corner and an intermediate corner between said lower and upper corners the bars are movable between: i) a lower stacking bar position in which pivot ends thereof rest in the lower corner of the opening, ii) an upper stacking bar position in which the pivot ends rest in the intermediate corner of the opening and iii) a nesting position in which the pivot ends rest in the upper corner of the opening.

9 Claims, 8 Drawing Sheets

(56) References Cited

U.S. PATENT DOCUMENTS

| | | | | |
|---|---|---|---|---|
| 8,561,799 | B2 | 10/2013 | Kapla et al. | |
| 2005/0224385 | A1* | 10/2005 | Hassell et al. | 206/506 |
| 2006/0231449 | A1* | 10/2006 | Hassell et al. | 206/506 |
| 2012/0048821 | A1 | 3/2012 | Kapla | |
| 2012/0073248 | A1 | 3/2012 | Stahl | |

FOREIGN PATENT DOCUMENTS

| | | |
|---|---|---|
| CA | 2431444 C | 12/2004 |
| CA | 2578840 | 4/2006 |
| CA | 2539678 | 10/2006 |
| CA | 2751182 | 3/2012 |
| CA | 2751194 | 3/2012 |

* cited by examiner

MULTI-LEVEL STACKING CONTAINER

CROSS REFERENCE TO RELATED APPLICATIONS

This application claims benefit of U.S. provisional application Ser. No. 61/901,824, filed on Nov. 8, 2013. All documents above are incorporated herein in their entirety by reference.

SUMMARY OF THE INVENTION

More specifically, in accordance with the present invention, there is provided a container comprising a base; a first and a second pairs of opposite sidewalls extending from the base to a lip, the lip running around the perimeter of the container and delimiting an upper collar, the upper collar having a height h from the lip to an upper rim of the container; a pair of bars operatively coupled to and extending across the first pair of opposite sidewalls; wherein each one of the first pair of opposite sidewalls comprises an outer wall and an inner wall separated by a recess; the inner wall comprises an upper supporting surface, a lower supporting surface and a nesting surface; the outer wall comprises a first opening located below the lip, and a second opening located between the upper rim of the container and the lip; wherein each bar comprises an elongated member and first and second lateral arms at each end of the elongated member at a generally perpendicular angle from the elongated member and forming an elbow, each arm comprising a pivot end opposite the elbow, the pivot end being received in the second opening; and wherein, the bars are movable between: i) a lower stacking bar position in which the lateral arms of the bar are rotated down in the recess between the outer wall and the inner wall, and the elbows rest on the lower supporting surface, ii) an upper stacking bar position in which the lateral arms are rotated up in the recess between the outer wall and the inner wall and the elbows rest on the upper supporting surface, and iii) a nesting position in which the lateral arms are rotated up in the recess between the outer wall and the inner wall and the elbows rest on the nesting surface.

There is further provided a method of manufacturing a container, comprising injection-molding a base, a first and a second pairs of opposite sidewalls extending from the base to a lip delimiting an upper collar having a height h from the lip to an upper rim of the container; each one of the first pair of opposite sidewalls comprising an outer wall and an inner wall separated by a recess; the inner wall comprising an upper supporting surface, a lower supporting surface and a nesting surface; the outer wall comprising a first opening located below the lip, and a second opening located between the upper rim of the container and the lip; providing a pair of bars, each comprising comprises an elongated member and first and second lateral arms at each end of the elongated member at a generally perpendicular angle from the elongated member and forming an elbow, each arm comprising a pivot end opposite the elbow; and positioning the bars across the first pair of opposite sidewalls, each pivot end of a bar being received in the second opening across the first pair of opposite sidewalls; wherein, the bars are movable between: i) a lower stacking bar position in which the lateral arms of the bar are rotated down in the recess between the outer wall and the inner wall, and the elbows rest on the lower supporting surface, ii) an upper stacking bar position in which the lateral arms are rotated up in the recess between the outer wall and the inner wall and the elbows rest on the upper supporting surface, iii) and a nesting position in which the lateral arms are rotated up in the recess between the outer wall and the inner wall and the elbows rest on the nesting surface.

Other objects, advantages and features of the present invention will become more apparent upon reading of the following non-restrictive description of specific embodiments thereof, given by way of example only with reference to the accompanying drawings.

DESCRIPTION OF ILLUSTRATIVE EMBODIMENTS

The present invention is illustrated in further details by the following non-limiting examples.

Figure 1:
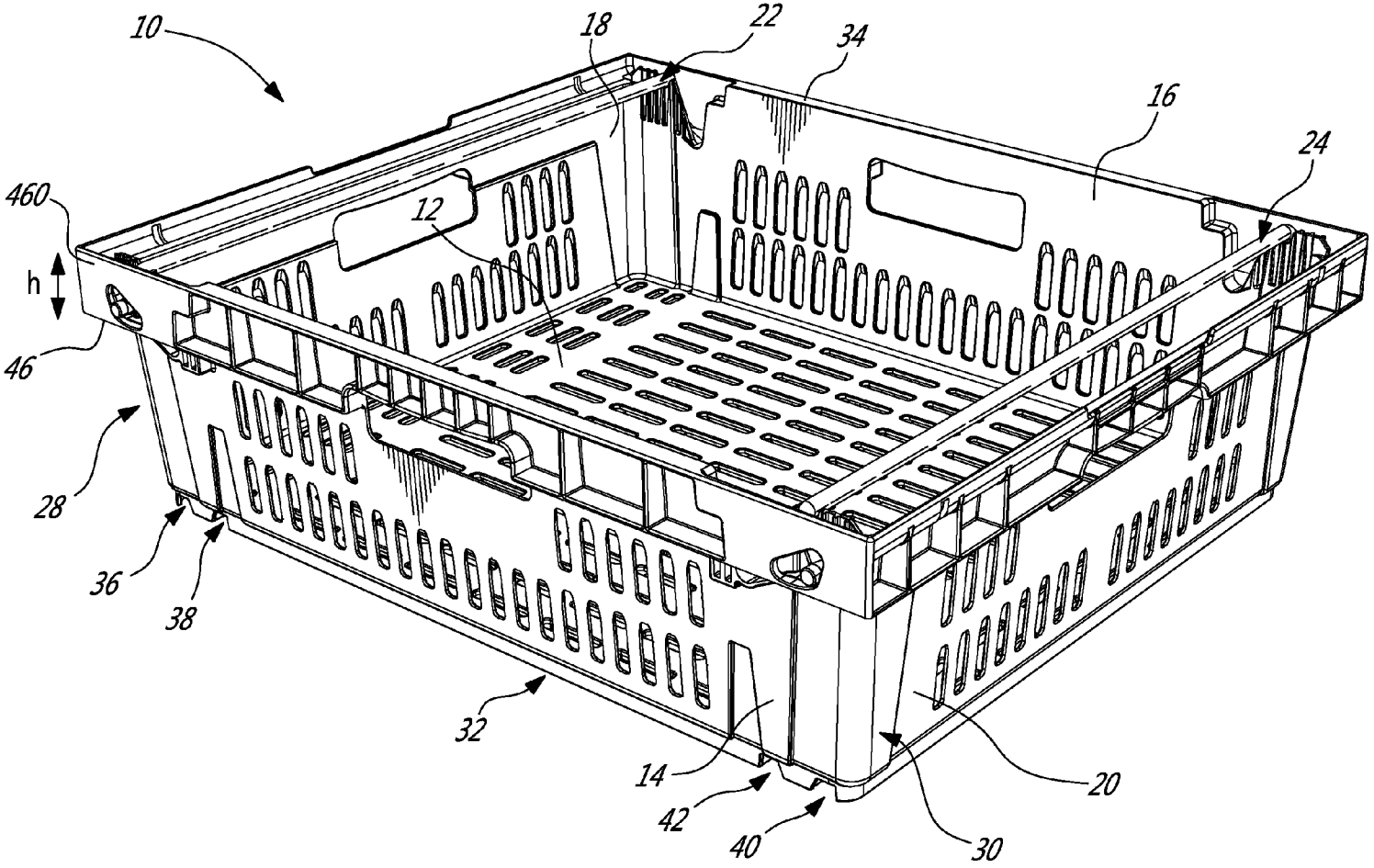
FIG. 1 is a perspective view of a container according to an embodiment of an aspect of the present invention.

As illustrated in FIG. 1, a container 10 according to an embodiment of an aspect of the present invention comprises a base 12, a pair of opposed sidewalls 1416 and 1820 extending from the base 12, and a pair of moveable support bars 22, 24 operatively coupled to and extending across the pair of opposed sidewalls 1416 for example, each support bar 22, 24 being moveable between two stacking positions such that the container 10 is stackable in two positions (see positions $S_{supper}$ and $S_{lower}$ in FIG. 8), according to the volume content of the container, with a second, like or compatible, container (see FIG. 7) when the containers are full; as well as a nesting position (see position $S_{nesting}$ in FIG. 8) for stacking empty containers, as will be described hereinbelow.

Figure 7:
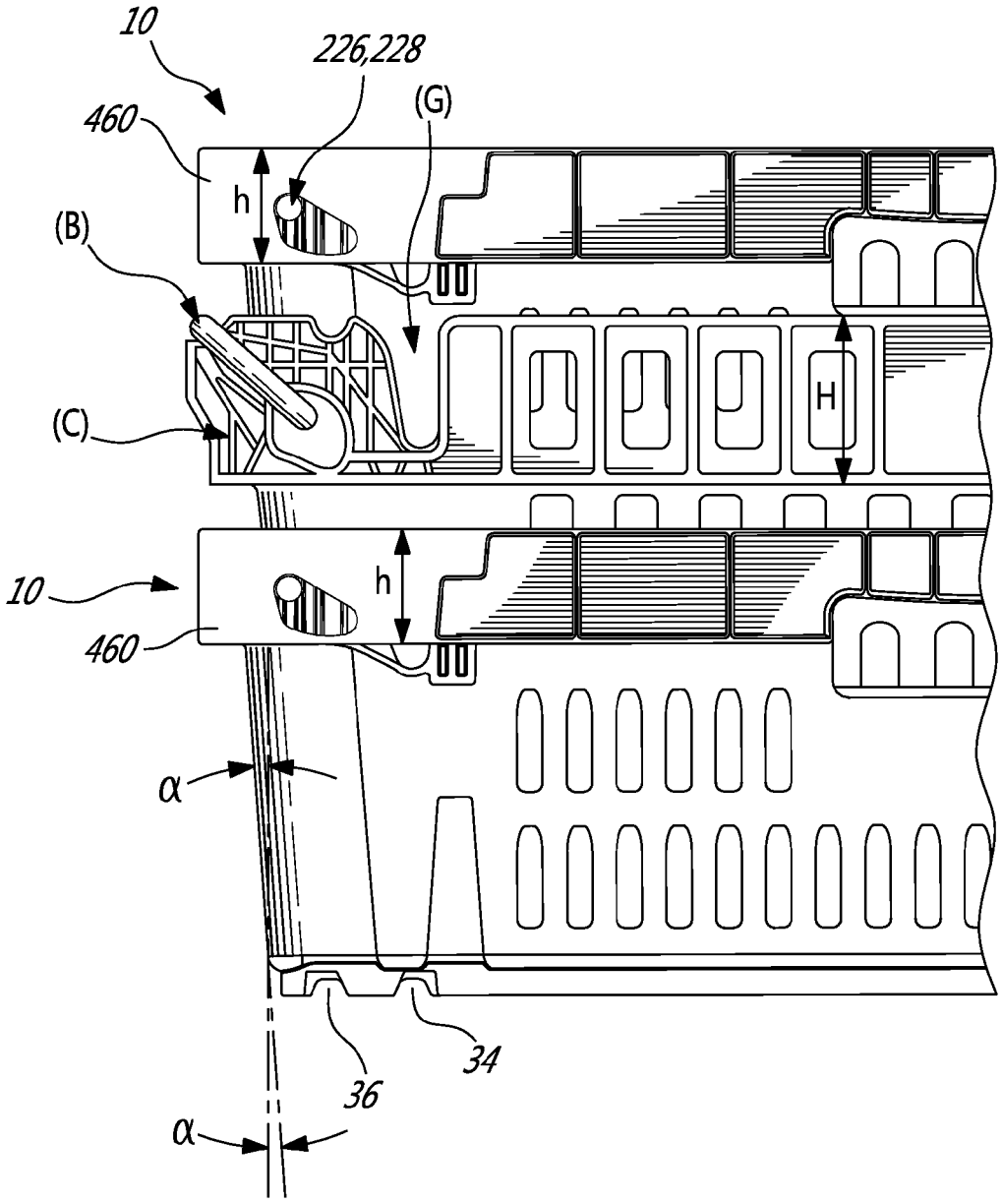
FIG. 7 shows nested containers.

Each one of the sidewalls 14, 16, 18, 20 projects from the edges of the base 12 at an obtuse angle (see angle α, FIG. 7 for example). Such geometry permits nesting a first container 10 into a similar (like or compatible) second container when the second-bottom-container is empty.

The base 12 and the sidewalls 14, 16, 18, 20 may be injection-molded in high-density polyethylene or polypropylene for example. The support bars 22, 24 may be made in metal, such as stainless steel for example, in plastic, such as thermoplastic for example, or they may be hybrid, such as metallic with plastic molded pivot ends for example.

As best seen in FIG. 1, each one of sidewalls 14, 16 comprises a first outer notch 36, proximal a lateral edge 28 thereof, and a first inner notch 38, laterally spaced from the first outer notch 36 away from the lateral edge 28, and a second outer notch 40 proximal the opposite lateral edge 30 and a second inner notch 42 laterally spaced from the second outer notch 40 away from the lateral edge 30, on the basal edge 32 of the sidewall 14, 16. These notches 38, 36 and 40, 42 receive the support bars 22, 24 respectively of a second similar container when stacked as known in the art. The outer notches 36, 40 are used for stacking containers with the bars in the upper position (see position $S_{upper}$ in FIG. 8), while the inner notches 38, 42 are used for stacking containers with the bars in the lower position (see position $S_{lower}$ in FIG. 8).

Figure 3:
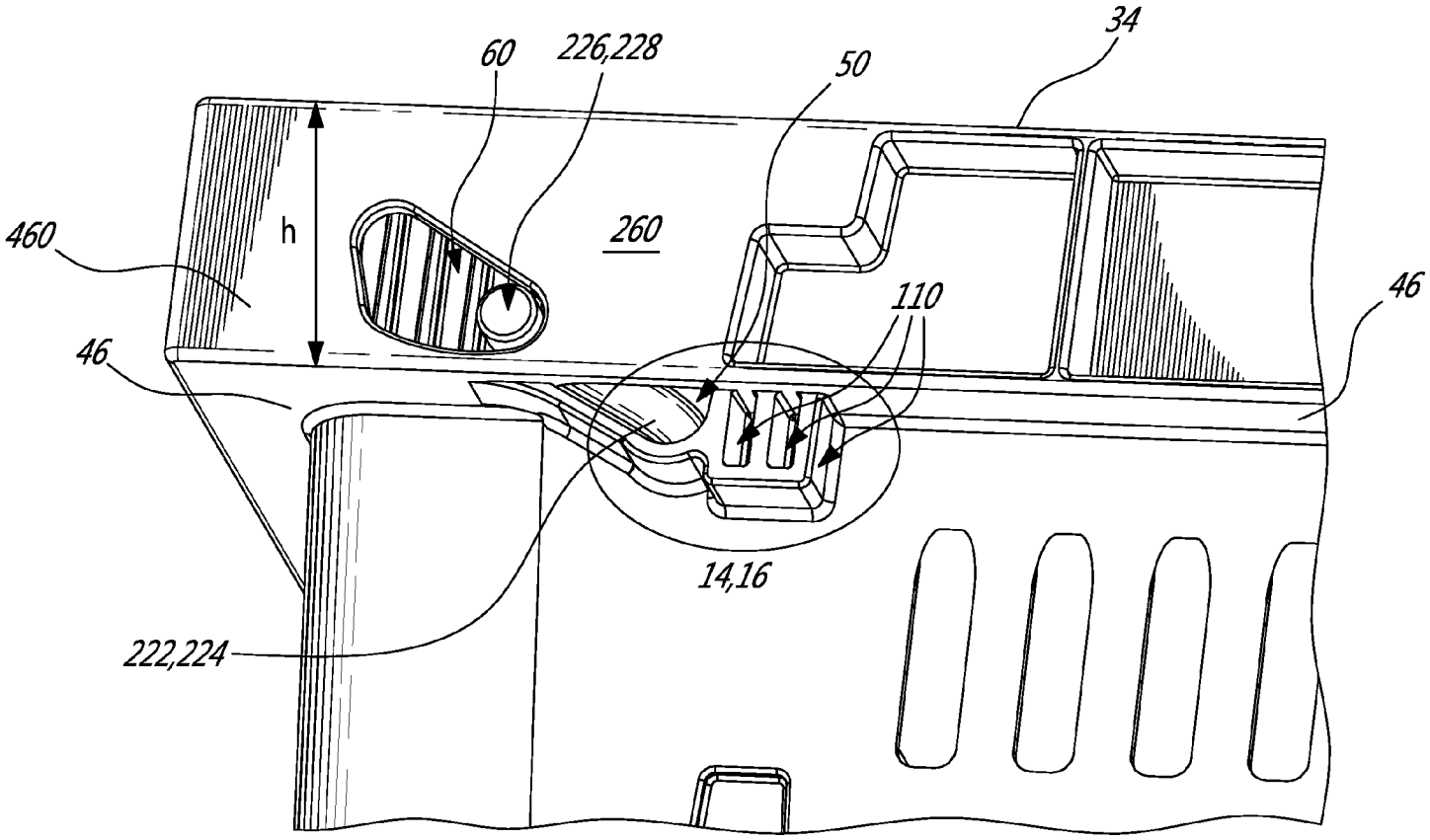
FIG. 3 is a detail of an outside view of the container of FIG. 1 with the support bar in tan lower position.

A nesting lip 46 runs around the perimeter of the container 10, delimiting an upper collar 460 of a height h from the upper edge of the container 10, as best seen in FIG. 3. The lip 46 extends peripherally from the outer surface of the sidewalls 14, 16, 18, and 20 substantially parallel to their respective upper rim along the length of the sidewalls. This lip 46 rests or is supported on the upper rims of a second, empty, bottom container when the container 10 is nested therein.

Figure 2:
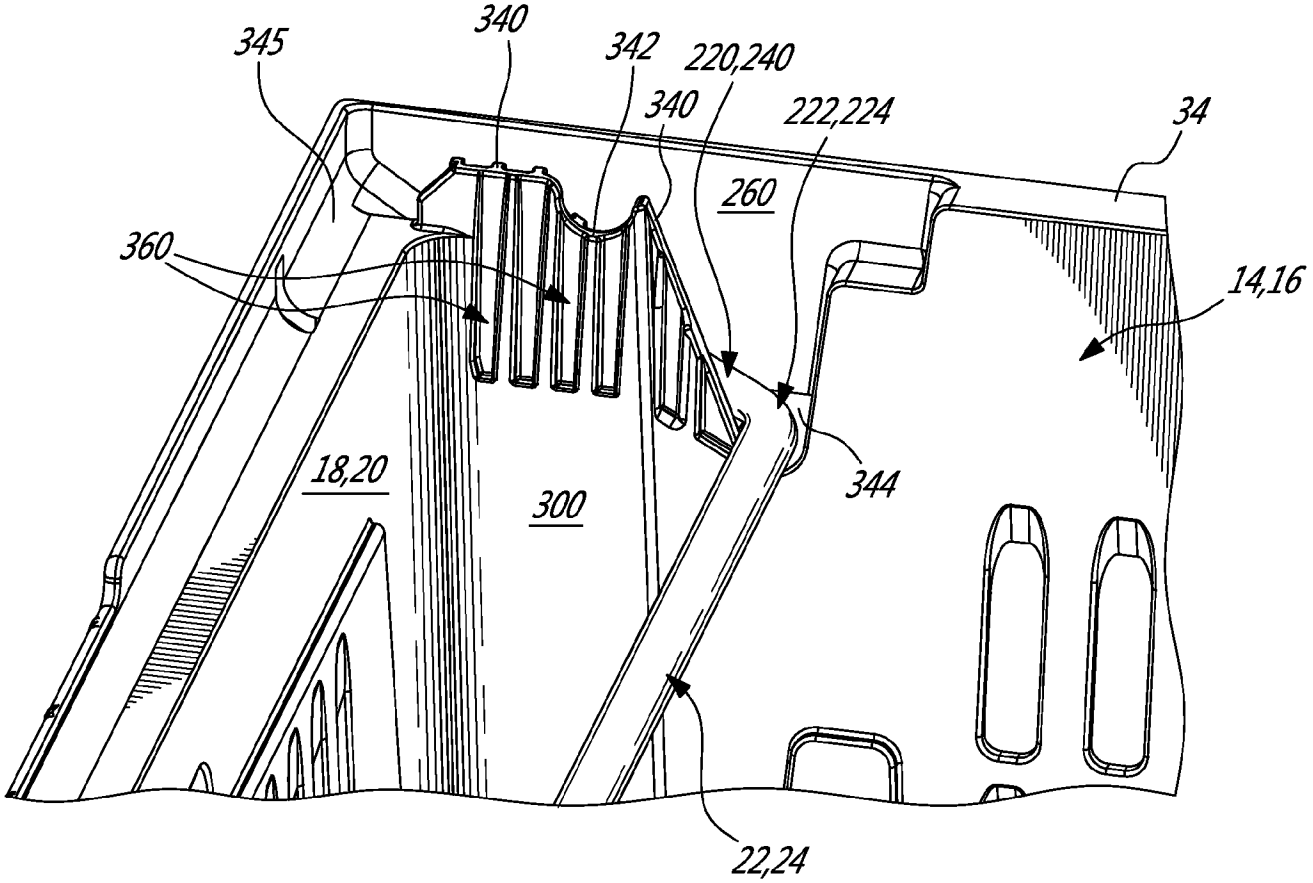
FIG. 2 is a detail of an inside view of the container of FIG. 1 with a support bar in a lower position.
Figure 4:
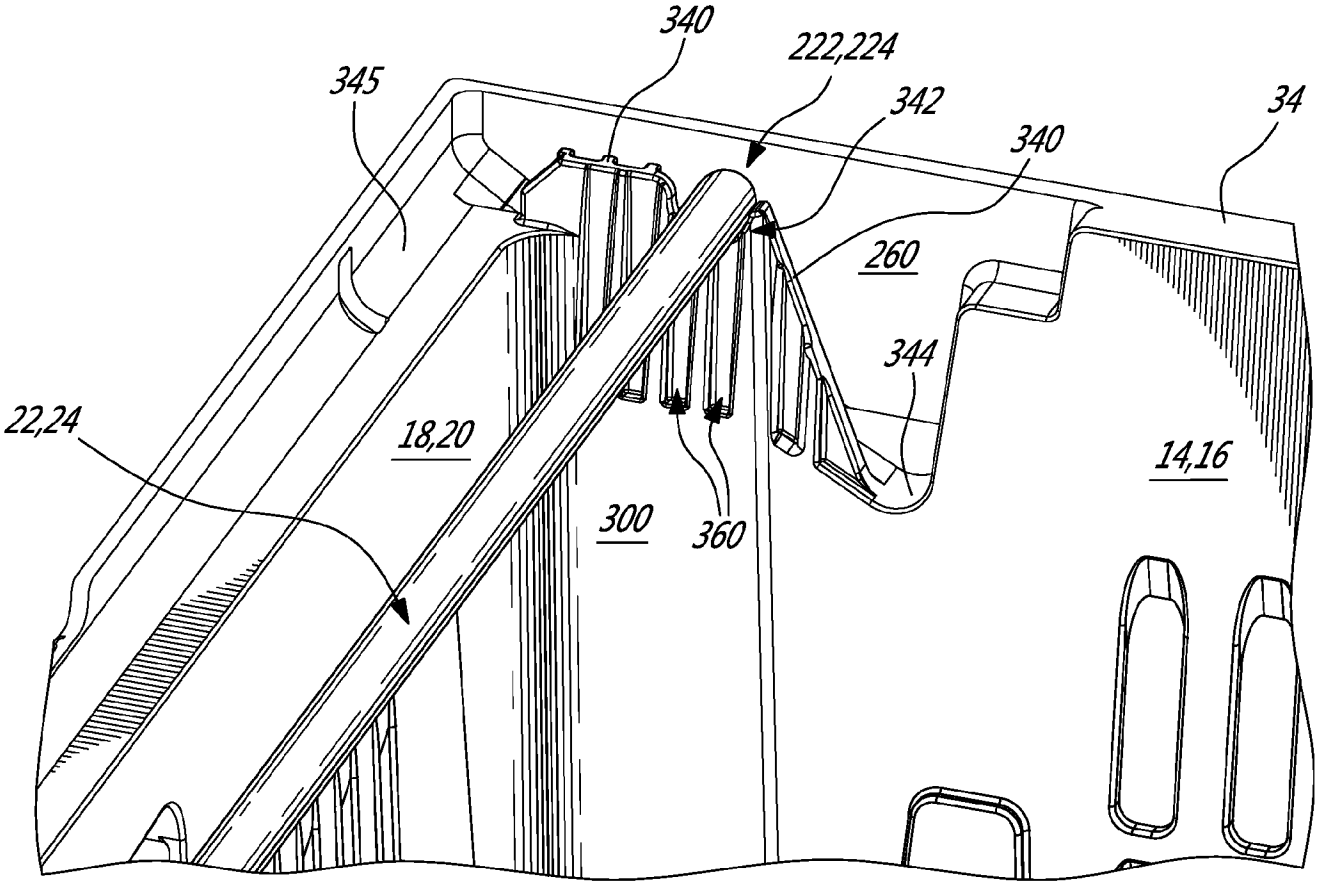
FIG. 4 is a detail of an inside view of the container of FIG. 1 with the support bar in an upper position.

As best seen in FIGS. 2 and 4, each sidewall 14, 16, at a region close to the junction with the sidewalls 18, 20, is formed of an outer wall 260 and an inner well 300 separated by an empty space or recess. The outer wall 260 is of the same height as the height of the sidewall 14, 16 from the base 12 to the upper rim 34 of the sidewall 14, 16, whereas the inner well 300 has a lower, varying height from the base 12, thereby forming an inner rim 340 comprising an upper supporting surface 342, a lower supporting surface 344 and a nesting surface 345, allowing respectively the positions $S_{upper}$, $S_{lower}$ and $S_{nesting}$ of the support bars 22, 24 as shown in phantom lines FIG. 8).

The inner wall 300 is reinforced with a structure of structural ribs 360, which is selected for a loaded bar 22, 24, as will be described hereinbelow in relation to FIGS. 4 and 5.

A best seen in FIGS. 3 and 5, the outer wall 260 comprises a first opening 50 located below the lip 46, and a second opening 60 located between the upper rim 34 and the lip 46. The perimeter of the first opening 50 is reinforced with ribs 110 to support the bar 22, 24 in the lower position as will be described hereinbelow in relation to FIGS. 2 and 3. The inner wall 300 is reinforced by the internal ribs 360 structure under the second opening 60 described hereinabove, and best seen on FIG. 2.

Such combination allows that the nesting collar 460 has a reduced height h, for example of 1.7", as opposed to a height H of 2¼" or 2½" as known in the art (see FIG. 7). Moreover, the nesting collar 460 has a constant height h around the perimeter of the container 10, and is devoid of grooves which result in weakening the load resistance of standard containers (C) when stacked (see groove (G) in collar of standard container (C) in FIG. 7).

Figure 6:
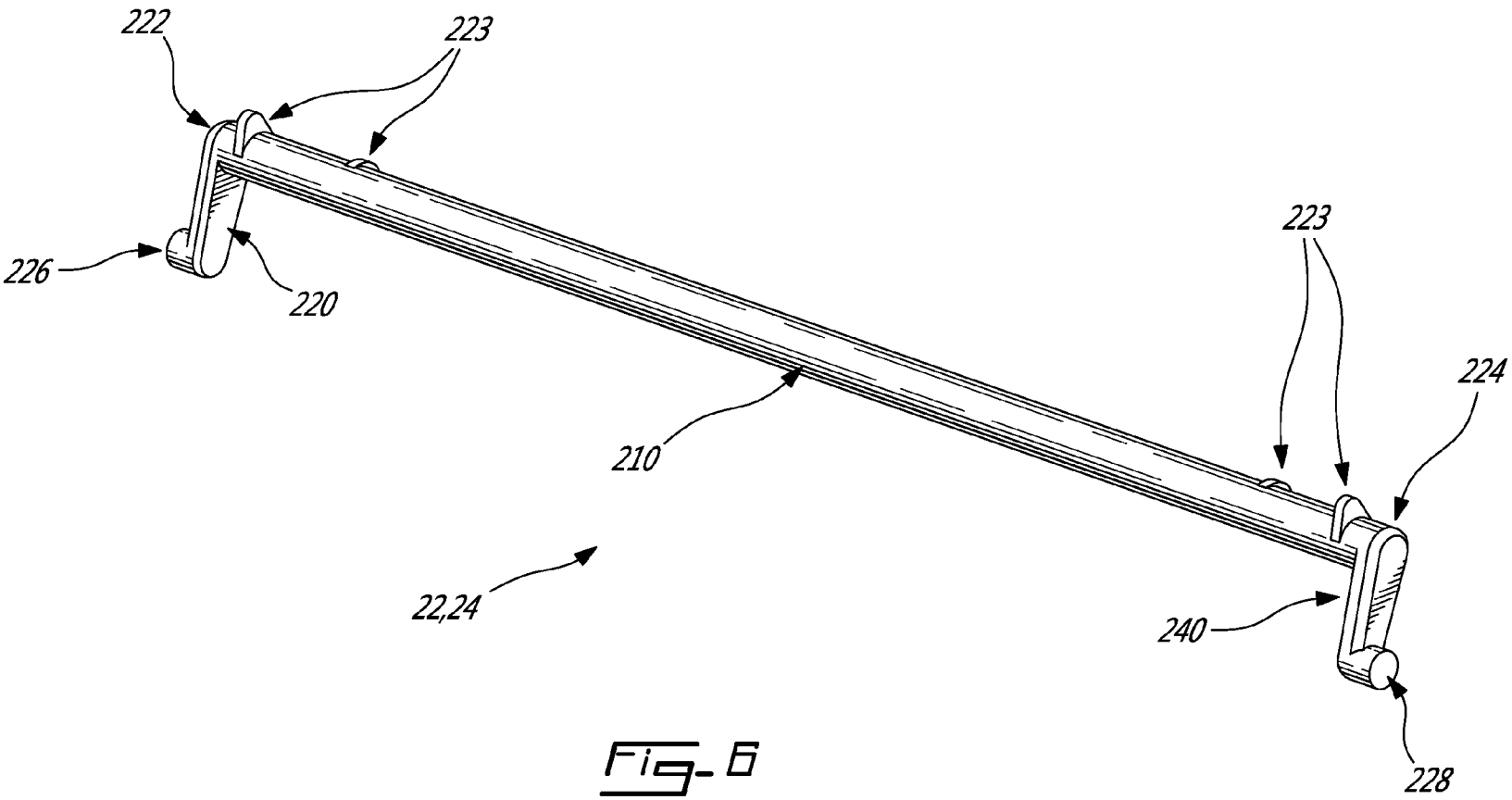
FIG. 6 is a perspective view of a support bar according to an embodiment of an aspect of the present invention.

In FIG. 6, the bar 22, 24 is shown as an elongated member 210, with first and second lateral arms 220, 240 at each end of the elongated member 210 at a generally perpendicular angle from the elongated member 210, forming elbows 222, 224. Each arm 220, 240 comprises a pivot end 226, 228 opposite the elbows 222, 224. As shown for example in FIGS. 6 and 8, stops 223 protruding from the elongated member 210 may be provided to prevent translations of stacked containers along the direction of the bars.

The pivot ends 226, 228 are received in the opening 60 located between the upper rim 34 and the lip 46 of respective opposite was 14, 16 shown in FIG. 3 for example.

Figure 8:
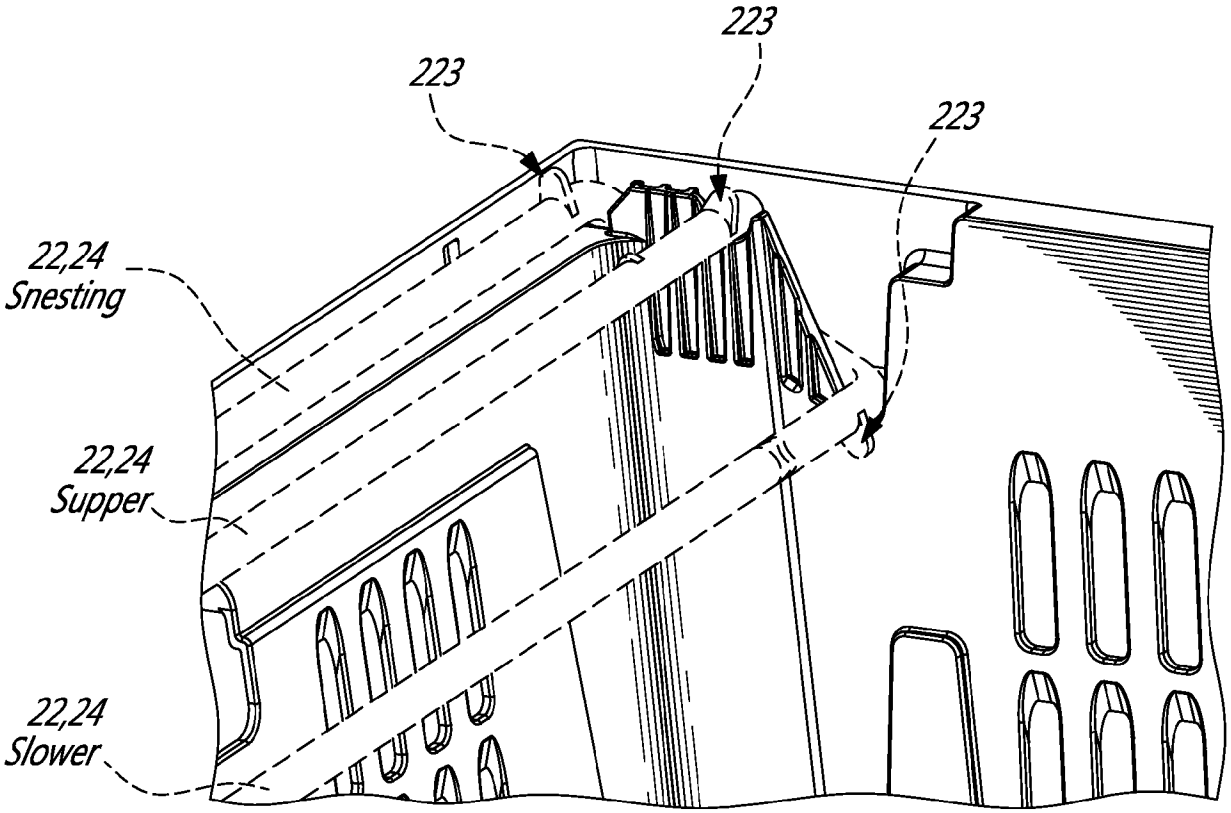
FIG. 8 is a detail of an inside view of a container according to an embodiment of an aspect of the present invention, showing the support bar in the lower position, in the upper position and in the nesting position.

In a lower stacking bar position as shown in FIG. 2, 3 or 8, the arms 220, 240 of the bar 22, 24 are rotated down in the recess between the outer wall 260 and the inner wall 300, and the elbows 222, 224 of the support bar 22, 24 are received by the first opening 50 and rest on the lower supporting surface 344 of the inner rim 340. The load of containers stacked above is thus distributed on the upper surface of the bars and on the lower supporting surface 344.

Figure 5:
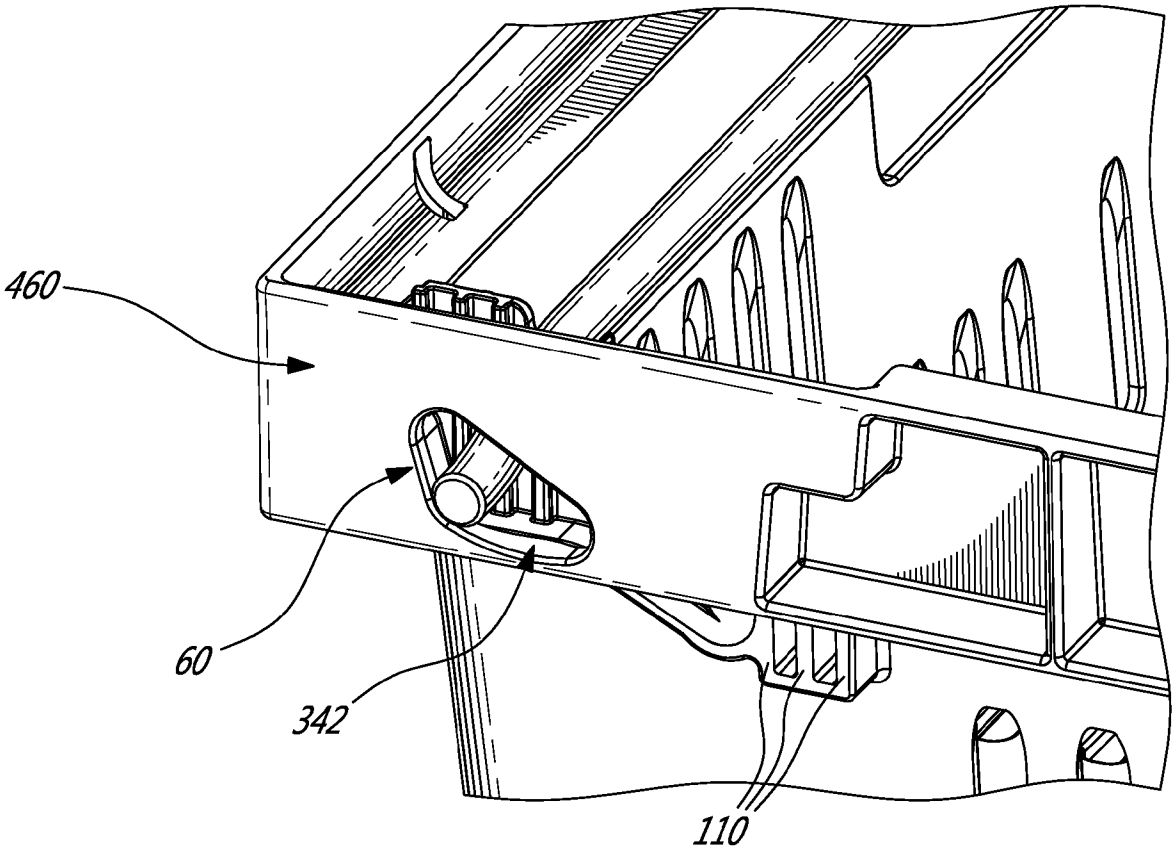
FIG. 5 is a detail of an outside view of the container of FIG. 1 with the support bar in an upper position.

In an upper stacking bar position shown in FIG. 4, 5 or 8, the arms 220, 240 of the bar 22, 24 are rotated up in the recess between the outer wall 260 and the inner wall 300 and the elbows 222, 224 rest on the upper supporting surface 342 of the inner rim 340. In this upper stacking bar position, the load of containers stacked above is thus distributed on the upper surface of the bars, on the upper supporting surface 342 and on the internal ribs 360 structure below and about the opening 60, resulting in an increased load resistance.

The double wall structure 260, 300 thus provides an increased load resistance as compared to containers (C) as show for example in FIG. 7.

The double wall structure 260, 300 allows accommodating the lateral arms of the bars so that the lateral arms and the elbows of the bars do not protrude on the outside of the containers as opposed to bar (B) of container (C) (see FIG. 7). Moreover, the double wall structure provides an increased resistance to load, the pivot end 226, 228 partially supporting the load when containers are stacked in the upper position.

As shown in FIG. 7 (nesting positions), the present container allows a more efficient nesting than standard containers (C), by providing a shorter nesting collar 460 (h lower than H): the shorter nesting collar 460 allows a lower nesting height when empty containers are stacked.

The scope of the claims should not be limited by the embodiments set forth in the examples, but should be given the broadest interpretation consistent with the description as a whole.

The invention claimed is:

1. A container comprising:

a base;

a first and a second pairs of opposite sidewalls extending from the base to a lip, the lip running around the perimeter of the container and delimiting an upper collar extending to an upper rim of the container; and a pair of bars operatively coupled to and extending across the first pair of opposite sidewalls;

wherein each one of the first pair of opposite sidewalls comprises an outer wall and an inner wall separated by a recess; said inner wall comprising an upper supporting surface, a lower supporting surface and a nesting surface; said outer wall comprising an opening located between the upper rim and the lip of the container, said opening comprising a lower corner, located at a first height from said lip; an intermediate corner, located at a second height from said lip, said second height being larger than said first height; and an upper corner, located at a third height from said lip, said third height being larger that said second height;

wherein each bar comprises an elongated member and first and second lateral arms extending at each end of the elongated member at a generally perpendicular angle from the elongated member and thereby forming an elbow, each arm comprising a pivot end at a free end thereof;

wherein, each bar is movable between:

i) a lower stacking bar position in which the pivot ends rest in the lower corner of said opening, the lateral arms of the bar are rotated down in the recess between the outer wall and the inner wall, and the elbows rest on the lower supporting surface;

ii) an upper stacking bar position in which the pivot ends rest in said intermediate corner of said opening, the lateral arms are rotated up in the recess between the outer wall and the inner wall and the elbows rest on the upper supporting surface; and iii) a nesting position in which the pivot ends rest in said upper corner of said opening, the lateral arms are rotated up in the recess between the outer wall and the inner wall and the elbows rest on the nesting surface; and wherein said lateral arms and said elbows of said bars are contained in between said outer wall and said inner wall in all said positions of the bars.

2. The container of claim 1, wherein each one of the sidewalls of the first pair comprises, on a basal edge of the sidewall, a first outer recess proximal a lateral edge thereof, a first inner recess, laterally spaced from the first outer recess away from the lateral edge, a second outer recess proximal an opposite lateral edge and a second inner recess laterally spaced from the second outer recess away from the lateral edge.

3. The container of claim 1, wherein the sidewalls extend from the base at an obtuse angle.

4. The container of claim 1, wherein the base and the sidewalls are injection-molded.

5. The container of claim 1, wherein the bars are made in one of metal and plastic.

6. The container of claim 1, wherein the bars are made in metal and the pivot ends are made in plastic.

7. The container of claim 1, wherein said inner wall comprises structural ribs.

8. The container of claim 1, wherein each bar is provided with stops protruding from the elongated member.

9. A method of producing a container, comprising:

injection-molding a base, a first and a second pairs of opposite sidewalls extending from the base to a lip delimiting an upper collar extending to an upper rim of the container; each one of the first pair of opposite sidewalls comprising an outer wall and an inner wall separated by a recess; the inner wall comprising an upper supporting surface, a lower supporting surface and a nesting surface; the outer wall comprising an opening located between the upper rim of the container and the lip, the opening comprising a lower corner located at a first height from the lip, an intermediate corner located at a second height from the lip, and an upper corner located at a third height from the lip, the second height being larger than the first height and the third height being larger than the second height;

providing a pair of bars, each bar comprising an elongated member and first and second lateral arms at each end of the elongated member at a generally perpendicular angle from the elongated member and thereby forming an elbow, each arm comprising a pivot end at a free end thereof; and positioning the bars across the first pair of opposite sidewalls, each pivot end of a bar being received in the opening across the first pair of opposite sidewalls;

wherein, each bar is movable between:

i) a lower stacking bar position in which the pivot ends rest in the lower corner of said opening, the lateral arms of the bar are rotated down in the recess between the outer wall and the inner wall, and the elbows rest on the lower supporting surface;

ii) an upper stacking bar position in which the pivot ends rest in the intermediate corner of said opening, the lateral arms are rotated up in the recess between the outer wall and the inner wall and the elbows rest on the upper supporting surface; and iii) a nesting position in which the pivot ends rest in said upper corner of said opening, the lateral arms are rotated up in the recess between the outer wall and the inner wall and the elbows rest on the nesting surface; and wherein the lateral arms and the elbows of the bars are contained in between the outer wall and the inner wall in all the positions of the bars.

* * * * *